US008210964B2

(12) United States Patent
Horne

(10) Patent No.: US 8,210,964 B2
(45) Date of Patent: Jul. 3, 2012

(54) PROP ROD FOR GOLF CLUB

(76) Inventor: Patrick Mallory Horne, Waverly, GA (US)

( * ) Notice: Subject to any disclaimer, the term of this patent is extended or adjusted under 35 U.S.C. 154(b) by 268 days.

(21) Appl. No.: 12/629,120

(22) Filed: Dec. 2, 2009

(65) Prior Publication Data

US 2010/0137070 A1 Jun. 3, 2010

Related U.S. Application Data

(60) Provisional application No. 61/119,644, filed on Dec. 3, 2008.

(51) Int. Cl.
*A63B 55/10* (2006.01)
*A63B 53/00* (2006.01)

(52) U.S. Cl. ..... 473/282

(58) Field of Classification Search ..... D21/796; 248/156, 530; 473/282, 243; 403/109.1–109.8
See application file for complete search history.

(56) References Cited

U.S. PATENT DOCUMENTS

| | | | | | |
|---|---|---|---|---|---|
| 1,331,499 | A * | 2/1920 | Hartford | 473/243 |
| 2,002,108 | A * | 5/1935 | Child | 473/239 |
| 4,462,595 | A * | 7/1984 | Hodson | 473/243 |
| 5,029,860 | A * | 7/1991 | Ehrich | 473/296 |
| 5,282,622 | A * | 2/1994 | Evans | 473/243 |
| 5,639,057 | A * | 6/1997 | Yeomans | 248/530 |
| 5,730,404 | A * | 3/1998 | Evans et al. | 248/156 |
| 6,213,890 | B1 * | 4/2001 | Prince | 473/292 |
| 6,283,874 | B1 * | 9/2001 | Studebaker | 473/227 |
| 6,390,931 | B1 * | 5/2002 | Berndt | 473/282 |
| 6,482,103 | B1 * | 11/2002 | Vache | 473/282 |
| 6,962,536 | B2 * | 11/2005 | Hall et al. | 473/282 |
| 7,568,306 | B1 * | 8/2009 | Rice, Sr. | 43/21.2 |
| 2001/0035201 | A1 * | 11/2001 | Kuzmic | 135/15.1 |
| 2002/0091012 | A1 * | 7/2002 | Evans | 473/296 |
| 2003/0079766 | A1 * | 5/2003 | Arrowood et al. | 135/16 |
| 2003/0207721 | A1 * | 11/2003 | Hall et al. | 473/282 |
| 2004/0198527 | A1 * | 10/2004 | Hsieh | 473/282 |

* cited by examiner

*Primary Examiner* — Stephen L. Blau
(74) *Attorney, Agent, or Firm* — Nixon & Vanderhye P.C.

(57) ABSTRACT

A stand assembly for a golf club includes a plunge rod positionable within the club shaft and club head and displaceable between a retracted position and an extended position. In the extended position, at least a portion of the plunge rod is extended to an exterior of the golf club. A lock is disposed in a position to be engageable with the plunge rod in both the retracted position and the extended position. The lock selectively secures the plunge rod in at least the retracted position and the extended position.

14 Claims, 3 Drawing Sheets

PROP ROD FOR GOLF CLUB

CROSS-REFERENCES TO RELATED APPLICATIONS

This application claims the benefit of U.S. Provisional Patent Application Ser. No. 61/119,644, filed Dec. 3, 2008, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The invention relates to a stand assembly for a golf club and, more particularly, to a retractable prop rod insertable into the ground for supporting a golf club in a standing position.

When playing golf, it is not uncommon for a player to remove multiple clubs from a golf bag for executing a next stroke or series of strokes. For example, if a player's ball is close but not quite on the putting surface, the player may carry to the putting surface area a chipping club such as a wedge or the like for getting the ball on the putting surface and a putter to complete the hole after the ball is on the putting surface. For an average golfer, this is a regular occurrence during a course of a round.

Since the player is carrying multiple clubs, when it is time to execute the next stroke, the player typically places the unused club(s) on the ground. There are drawbacks to this situation particularly if the ground is wet or if the player has difficulty bending over to pick up the club or clubs on the ground. It is desirable to maintain club grips dry to avoid slipping and to prevent damage to the grip. Additionally, golfers with joint or back problems or the like may find it difficult or uncomfortable to retrieve a golf club from the ground.

BRIEF SUMMARY OF THE INVENTION

It would thus be desirable to provide a stand assembly for a golf club that can enable the golf club to stand in an upright position when not in use. It would also be desirable for such a device to be incorporated into the club itself and to be easily extractable and retractable without affecting the functionality of the club.

In an exemplary embodiment, a stand assembly for a golf club includes a plunge rod positionable within the club shaft and club head and displaceable between a retracted position and an extended position. In the extended position, at least a portion of the plunge rod is extended to an exterior of the golf club. A lock is disposed in a position to be engageable with the plunge rod in both the retracted position and the extended position. The lock selectively secures the plunge rod in at least the retracted position and the extended position. In a preferred embodiment, in the retracted position, the plunge rod is disposed completely within the golf club.

The plunge rod preferably has a tapered end to facilitate insertion into a ground surface. The lock may include a lock pin disposed in an opening in one of the club shaft and the club head, where the lock pin is selectively engageable with the plunge rod. In this context, the lock pin may be threaded in the opening In one arrangement, the club head includes a club hosel, where the opening in which the lock pin is disposed is in the club hosel.

A vibration dampener may be disposed in the club shaft such that a top of the plunge rod is abutted against the vibration dampener in the retracted position.

The plunge rod is preferably displaceable between the retracted position and the extended position by gravity. The plunge rod may include an interior end and a distal end, where in the extended position, the distal end is extended to the exterior of the golf club. The plunge rod may additionally include a stopper at the interior end, where with the plunge rod in the extended position, the stopper is engageable with an interior shoulder in one of the club shaft and the club head.

In another exemplary embodiment, a golf club includes a club shaft, a club head secured to the club shaft, and a stand assembly cooperable with the club shaft and the club head. The stand assembly includes a plunge rod positioned within the club shaft and club head and displaceable between a retracted position and an extended position. In the extended position, at least a portion of the plunge rod is extended to an exterior of the golf club. The plunge rod may additionally include a lock disposed in a position to be engageable with the plunge rod in both the retracted position and the extended position. The lock selectively secures the plunge rod in at least the retracted position and the extended position. In one arrangement, a rod channel is formed in the club shaft and the club head, where the plunge rod is disposed in the rod channel, and where the lock is positioned adjacent the rod channel.

In yet another exemplary embodiment, a stand assembly for a golf club includes a plunge rod movably secured within the club shaft and club head and displaceable between a retracted position entirely within the club head and an extended position, where in the extended position, at least a portion of the plunge rod is extended through a channel in the club head to an exterior of the golf club. A lock is disposed in an aperture in the club head adjacent the channel. The lock is selectively engageable with the plunge rod to secure the plunge rod in both the retracted position and the extended position. A vibration dampener is disposed in the club shaft such that a top of the plunge rod is abutted against the vibration dampener in the retracted position.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
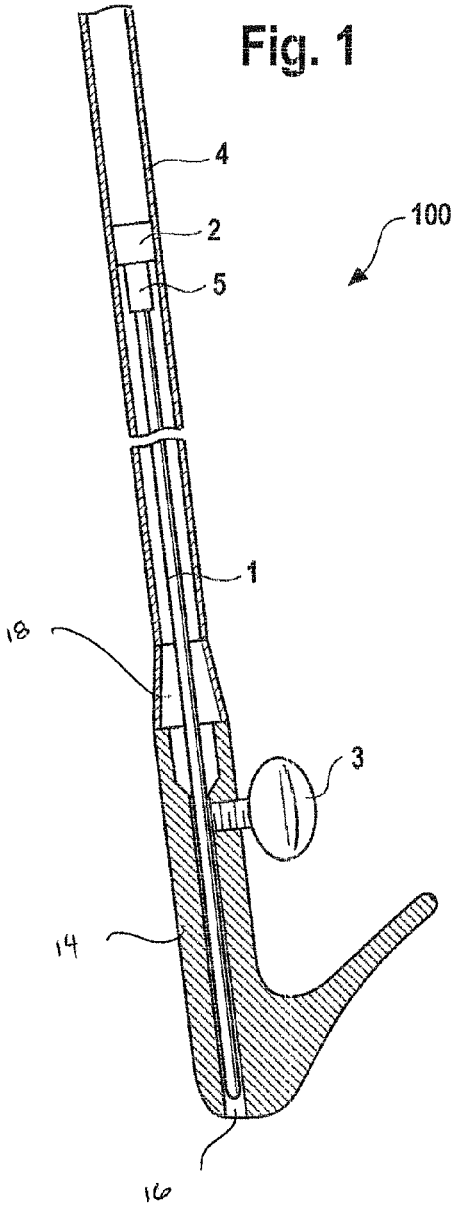
FIG. 1 is a cross sectional view of an exemplary stand assembly with the plunge rod in a retracted position.
Figure 2:
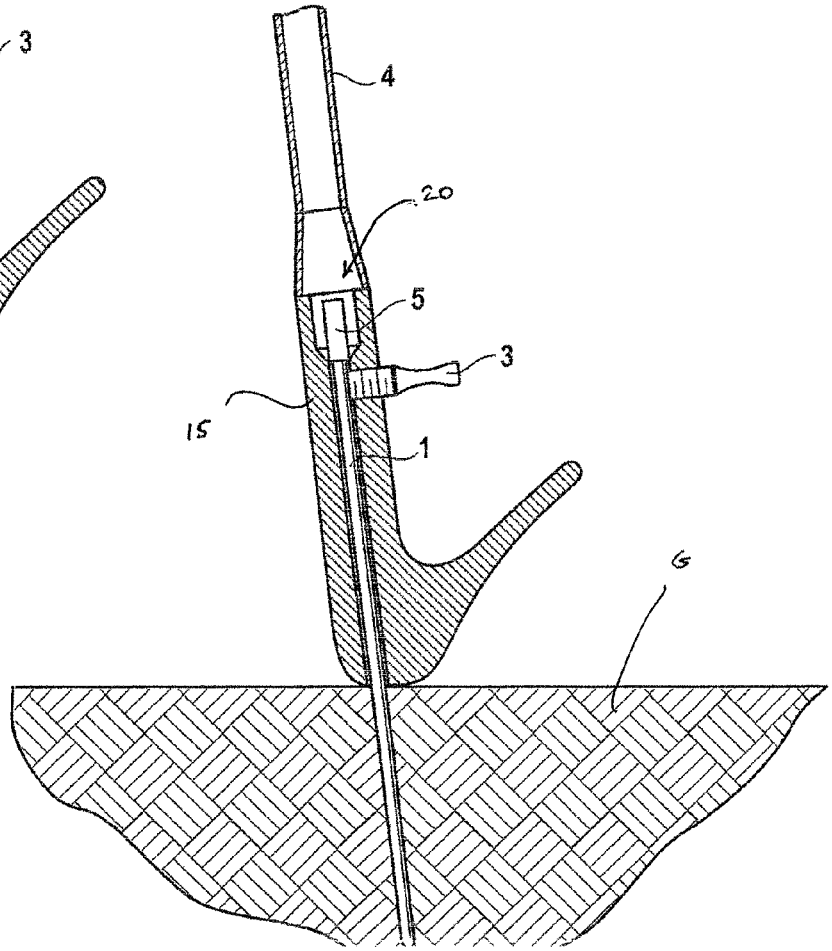
FIG. 2 is a cross sectional view of the stand assembly shown in FIG. 1 with the plunge rod in an extended position.

FIGS. 1 and 2 are cross sectional views of a stand assembly for a golf club according to a first embodiment. The stand assembly 100 is integrated with the golf club via a club shaft 4 and a club head 14 secured to the club shaft 4. The shaft 4 is typically hollow, and a channel 16 is formed in the club head 14, which together with the hollow club shaft define a rod channel 18.

The stand assembly 100 includes a plunge rod 1 positionable within the club shaft 4 and club head 14 and displaceable between a retracted position (FIG. 1), in which the plunge rod 1 is preferably disposed completely within the golf club, and an extended position (FIG. 2), in which at least a portion of the plunge rod 1 is extended to an exterior of the golf club. The stand assembly 100 also includes a lock 3 disposed in a position to be engageable with the plunge rod 1 in both the retracted position and the extended position. The lock 3 selectively secures the plunge rod 1 in position.

As shown in FIG. 2, in the extended position, with at least a portion of the plunge rod 1 extended to an exterior of the golf club, the plunge rod 1 is insertable into the ground G to support the club in a standing position. To facilitate insertion into the ground, the plunge rod 1 may be provided with a tapered end.

The lock 3 can be made of any suitable structure and configuration for the described purpose, and those of ordinary skill in the art will appreciate alternative locking structures. The invention is not necessarily meant to be limited to the exemplary illustrated lock. In FIGS. 1 and 2, in an exemplary embodiment, the lock comprises a lock pin 3 disposed in an opening in one of the club shaft and the club head (opening in club head shown in FIGS. 1 and 2), where the lock pin 3 is selectively engageable with the plunge rod 1. The shaft-like portion of the club head 14 is called the club hosel 15. Preferably, the lock pin 3 is disposed in an opening in the club hosel 15. As shown, the lock pin 3 is preferably threaded in the opening so that the plunge rod 1 can be secured in a desired position by tightening the lock pin 3 into engagement with the plunge rod 1.

The stand assembly 100 may additionally include a vibration dampener 2 disposed in the club shaft 4. The vibration dampener 2 is positioned such that a top of the plunge rod 1 is abutted against the vibration dampener 2 in the retracted position (see FIG. 1). The vibration dampener 2 prevents the plunge rod 1 from rattling within the club shaft and club head when the plunge rod 1 is in the retracted position.

As shown in FIGS. 1 and 2, the channel 16 formed in the club head 14 is narrower than an inside diameter of the club shaft 4. Preferably, the channel 16 is only slightly larger than a width or diameter of the plunge rod 1. A transition portion 20 is thus defined between the channel 16 in the club head 14 and the inside channel of the club shaft 4. In FIGS. 1 and 2, the transition portion is shown within the club head 14. The plunge rod 1 includes a stopper 5 at an interior end thereof (opposite from the distal end, which is extendible into the ground G in use). The stopper 5 is sized larger than the channel 16 through the club head 14 but smaller than the interior width of the club shaft 4. The stopper 5 thus engages the transition portion 20 in the extended position (shown in FIG. 2) to prevent the plunge rod 1 from falling out of the assembly.

The assembly may include additional internal components to increase the stability of the plunge rod and to accommodate varying club shaft internal diameters. For example, a sleeve or piece of tubing may be interposed between the plunge rod and the club shaft to effectively narrow the internal diameter of the club shaft relative to the plunge rod. In this manner, the plunge rod can better maintain a vertical attitude relative to the club shaft and avoid getting caught up in the rod channel. Additionally, the interior end of the plunge rod may be pointed to effect a more positive connection to the vibration dampener. In a related context, the vibration dampener may include a depression or indentation in a center thereof to receive the interior end of the plunge rod in the retracted position. These components may help to keep the plunge rod centered in the rod channel.

In use, when it is desired to extend the plunge rod 1 from the retracted position to the extended position, the user loosens the lock pin 3, and the plunge rod 1 extends by gravity into the extended position until the stopper 5 engages the transition portion 20 in the rod channel 18. Once in the extended position, the user then tightens the lock pin 3 to secure the plunge rod 1 in place. The user can then insert the extended portion of the plunge rod 1 into the ground G, and the club can be supported in an upright or standing position. In this manner, the user is not required to bend over to pick up the club on the ground, and the club grip is protected from coming in contact with the wet ground. When it is time to return the club to the user's golf bag or the like, the club is turned over for placement grip down into the golf bag, and when the lock pin 3 is loosened, with the club turned over, the plunge rod 1 falls back into the retracted position by gravity. Once back in the retracted position, the lock pin 3 can be tightened to secure the plunge rod 1 in place.

Figure 3:
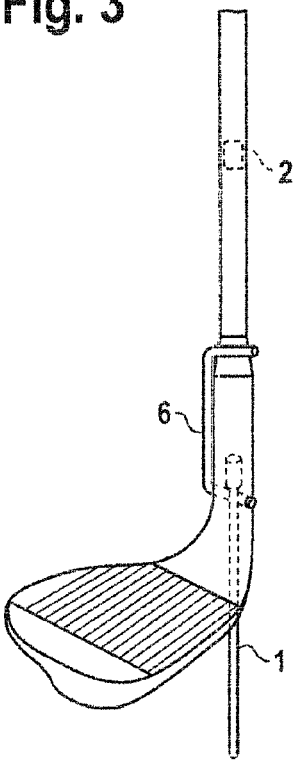
FIGS. 3 and 4 are perspective views of the stand assembly with an alternative lock.
Figure 4:
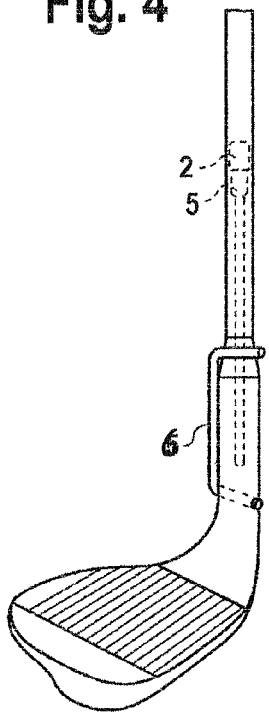

FIGS. 3 and 4 illustrate an alternative lock for securing the plunge rod 1 in the retracted and extended positions. The lock includes a cam lever or the like 6. In one position, a cam surface of the cam lever 6 engages the plunge rod 1, while in a displaced position, the cam surface disengages from the plunge rod 1. As noted, those of ordinary skill in the art will appreciate alternative constructions for the locking structure.

Figure 5:
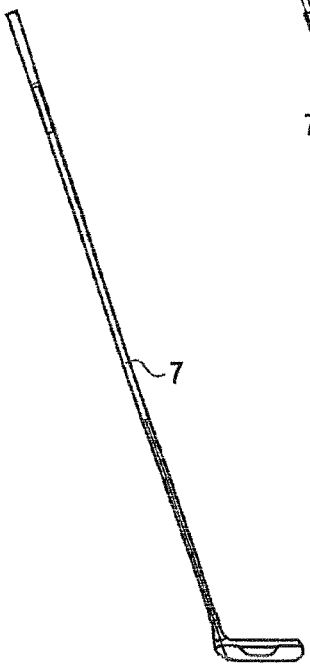
FIGS. 5-7 show yet another alternative construction for the stand assembly.
Figure 6:
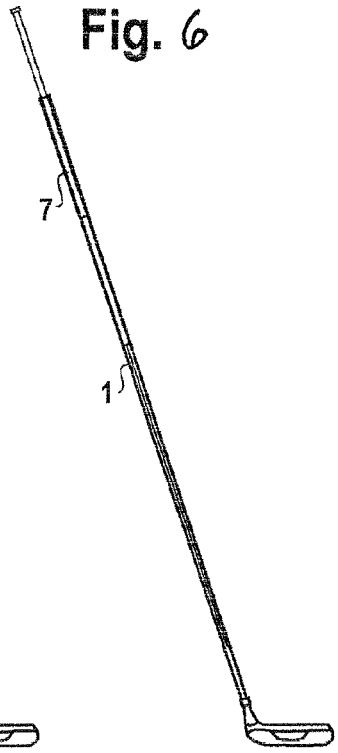
Figure 7:
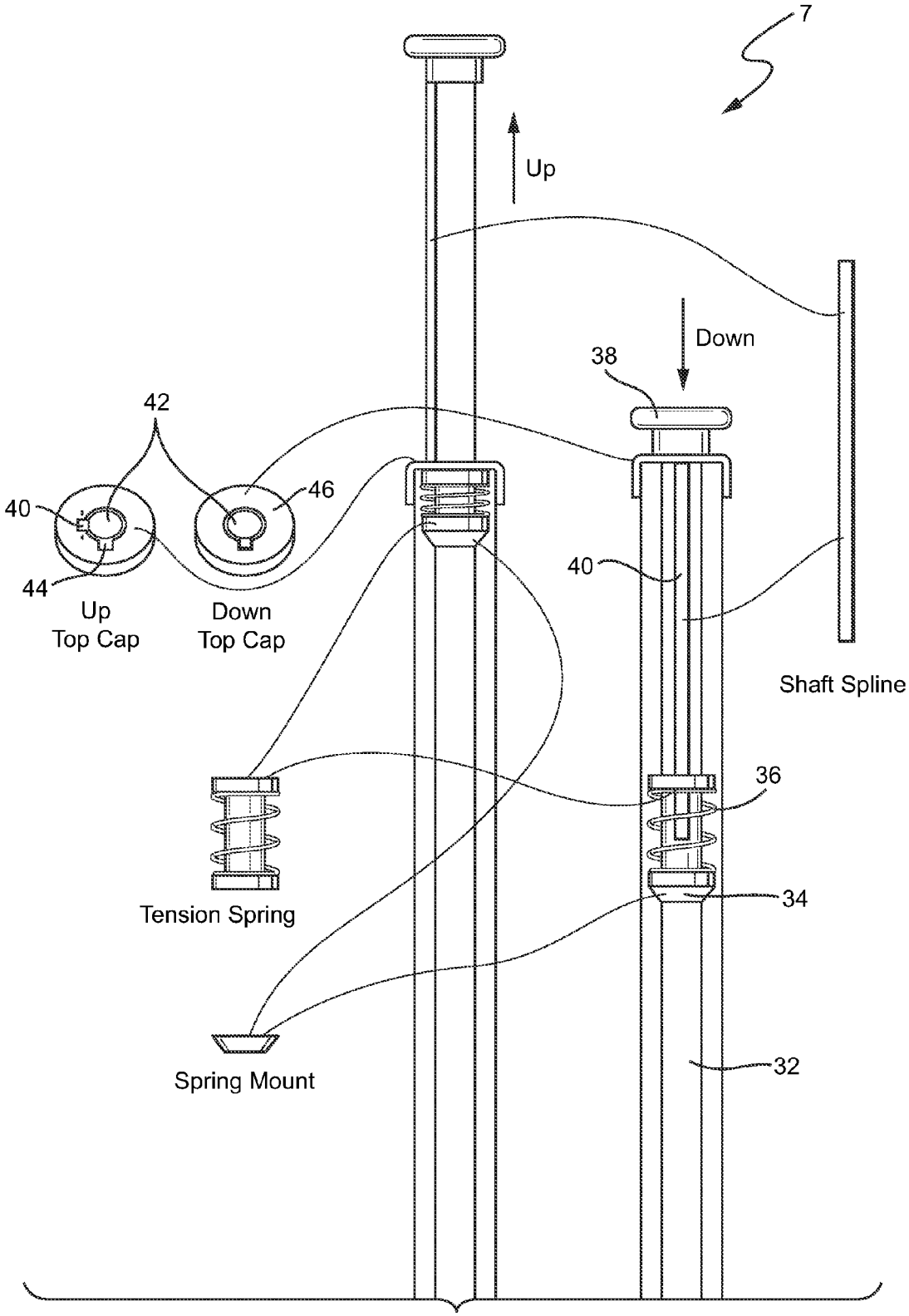

FIGS. 5-7 show yet another alternative embodiment of the stand assembly. As shown, the stand assembly includes a rotating locking handle 7 used to secure the plunge rod 1 in a fixed position. FIG. 5 shows the plunge rod 1 in the extended position, and FIG. 6 shows the plunge rod 1 in the retracted position. The plunge rod 1 slides within the club shaft and within the rotating locking handle 7.

Details of an exemplary construction are shown in FIG. 7. The plunge rod 1 is secured at a distal end of an actuator shaft 32. A spring mount 34 is fixed to the actuator shaft 32 and supports a tension spring 36. A top cap 38 is secured at a proximal end of the actuator shaft 32. The top cap 38 includes a key configuration 42 as shown including a slot 44 in which a shaft spline 40 attached to the actuator shaft 32 is slidable. In the retracted position, the top cap 38 and actuator shaft 32 are pulled upward until the tension spring 36 engages an end of the handle 7 and the shaft spline 40 is slid above the key configuration 42. The top cap 38 and handle 7 are then turned so that the shaft spline 40 engages a top surface 46 of the handle 7 by a force of the spring 36, thereby locking the assembly in the retracted position. To release the assembly into the extended position, the top cap 38 and shaft spline 40 are turned until the shaft spline 40 is aligned with the slot 44 in the key configuration 42. With the help of the tension spring 36, the top cap 38 and actuator shaft 32 fall by gravity to the extended position. In use, in the extended position, the plunge rod can be driven into the ground by pressing down on the top cap 38 and/or the assembly may include another locking mechanism for securing the assembly in the extended position.

With the integrated stand mechanism according to the described embodiments, a golf club can stand in an upright position when not in use. Additionally, the stand mechanism is easily extendable and retractable without affecting the functionality of the club.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A stand assembly for a golf club including a club shaft and a club head, the stand assembly comprising:

a plunge rod positionable within the club shaft and club head and displaceable between a retracted position and an extended position, wherein in the extended position, at least a portion of the plunge rod is extended to an exterior of the golf club; and a lock disposed in a position to be engageable with the plunge rod in both the retracted position and the extended position, the lock selectively securing the plunge rod in at least the retracted position and the extended position, wherein the lock comprises a lock pin disposed in an opening in one of the club shaft and the club head, the lock pin being selectively engageable with the plunge rod, wherein the club head comprises a club hosel, and wherein the opening in which the lock pin is disposed is in the club hosel.

2. A stand assembly according to claim 1, wherein in the retracted position, the plunge rod is disposed completely within the golf club.

3. A stand assembly according to claim 1, wherein the plunge rod has a tapered end to facilitate insertion into a ground surface.

4. A stand assembly according to claim 1, wherein the lock pin is threaded in the opening.

5. A stand assembly according to claim 1, wherein the plunge rod is displaceable between the retracted position and the extended position by gravity.

6. A stand assembly according to claim 1, wherein the plunge rod comprises an interior end and a distal end, and wherein in the extended position, the distal end is extended to the exterior of the golf club.

7. A stand assembly according to claim 6, wherein the plunge rod comprises a stopper at the interior end, and wherein with the plunge rod in the extended position, the stopper is engageable with an interior shoulder in one of the club shaft and the club head.

8. A stand assembly for a golf club including a club shaft and a club head, the stand assembly comprising:

a plunge rod positionable within the club shaft and club head and displaceable between a retracted position and an extended position, wherein in the extended position, at least a portion of the plunge rod is extended to an exterior of the golf club;

a lock disposed in a position to be engageable with the plunge rod in both the retracted position and the extended position, the lock selectively securing the plunge rod in at least the retracted position and the extended position; and a vibration dampener disposed in the club shaft such that a top of the plunge rod is abutted against the vibration dampener in the retracted position.

9. A golf club comprising:

a club shaft;

a club head secured to the club shaft;

a stand assembly cooperable with the club shaft and the club head, the stand assembly including:

a plunge rod positioned within the club shaft and club head and displaceable between a retracted position and an extended position, wherein in the extended position, at least a portion of the plunge rod is extended to an exterior of the golf club, and a lock disposed in a position to be engageable with the plunge rod in both the retracted position and the extended position, the lock selectively securing the plunge rod in at least the retracted position and the extended position; and a rod channel formed in the club shaft and the club head, wherein the plunge rod is disposed in the rod channel, and wherein the lock is positioned adjacent the rod channel, wherein the lock comprises a lock pin disposed in an opening in one of the club shaft and the club head, the lock pin being selectively engageable with the plunge rod, wherein the club head comprises a club hosel, and wherein the opening in which the lock pin is disposed is in the club hosel.

10. A golf club according to claim 9, wherein the lock pin is threaded in the opening.

11. A golf club according to claim 9, wherein the rod channel has a first width at an upper portion thereof, a second width at a lower portion thereof, and a transition portion therebetween, the second width being narrower than the first width.

12. A golf club according to claim 11, wherein the plunge rod comprises an interior end and a distal end, and wherein in the extended position, the distal end is extended to the exterior of the golf club.

13. A golf club according to claim 12, wherein the plunge rod comprises a stopper at the interior end, and wherein with the plunge rod in the extended position, the stopper is engaged with the transition portion between the upper portion and the lower portion of the rod channel.

14. A stand assembly for a golf club including a club shaft and a club head, the stand assembly comprising:

a plunge rod movably secured within the club shaft and club head and displaceable between a retracted position entirely within the club head and an extended position, wherein in the extended position, at least a portion of the plunge rod is extended through a channel in the club head to an exterior of the golf club;

a lock disposed in an aperture in the club head adjacent the channel, the lock being selectively engageable with the plunge rod to secure the plunge rod in both the retracted position and the extended position; and a vibration dampener disposed in the club shaft such that a top of the plunge rod is abutted against the vibration dampener in the retracted position.

* * * * *